US009037059B2

(12) United States Patent
Oomoto et al.

(10) Patent No.: US 9,037,059 B2
(45) **Date of Patent: *May 19, 2015**

(54) FIXING DEVICE AND IMAGE FORMING APPARATUS

(75) Inventors: Noboru Oomoto, Toyokawa (JP); Shoichi Yoshikawa, Okazaki (JP); Tadayasu Sekioka, Toyohashi (JP); Yoshiyuki Toso, Toyokawa (JP); Takashi Fujiwara, Hachioji (JP); Naoki Miyagawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 108 days.

This patent is subject to a terminal disclaimer.

(21) Appl. No.: 13/611,272

(22) Filed: Sep. 12, 2012

(65) Prior Publication Data

US 2013/0071153 A1 Mar. 21, 2013

(30) Foreign Application Priority Data

Sep. 20, 2011 (JP) ..... 2011-204485

(51) Int. Cl.
*G03G 15/20* (2006.01)

(52) U.S. Cl.
CPC .... *G03G 15/2032* (2013.01); *G03G 2215/2025* (2013.01); *G03G 15/2067* (2013.01)

(58) Field of Classification Search
CPC ..... G03G 15/2067; G03G 21/1857; G03G 2215/2025; G03G 2221/1657
USPC ..... 399/329
See application file for complete search history.

(56) References Cited

U.S. PATENT DOCUMENTS 8,805,259 B2 * 8/2014 Fujiwara et al. ..... 399/329

FOREIGN PATENT DOCUMENTS

JP 2008-096752 4/2008

* cited by examiner

*Primary Examiner* — David Gray
*Assistant Examiner* — Erika J Villaluna
(74) *Attorney, Agent, or Firm* — Lucas & Mercanti, LLP

(57) ABSTRACT

A fixing device includes a heating rotating body driven by a motor, a pressing member, a biasing unit, a switching unit that receives rotational power of the motor in order to either separate the pressing member and the heating rotating body or to allow the biasing unit to press the pressing member and the heating rotating body together, a power transmission mechanism that transmits the rotational power of the motor to the switching unit over a first path or a second path, the first path having a larger reduction ratio, and a transmission control unit that establishes and cuts off transmission of rotational power of the motor to the switching unit by the power transmission mechanism and that includes a path selection unit that selects the first path during separation and the second path during pressing by the switching unit.

6 Claims, 10 Drawing Sheets

FIXING DEVICE AND IMAGE FORMING APPARATUS

This application is based on application No. 2011-204485 filed in Japan, the contents of which are hereby incorporated by reference.

BACKGROUND OF THE INVENTION (1) Field of the Invention

The present invention relates to a fixing device and an image forming apparatus, and in particular to a fixing device and an image forming apparatus provided with the fixing device that have a structure allowing for switching of a pressing member between a pressing state and a separated state with respect to a heating rotating body of a fixing roller or the like.

(2) Description of the Related Art

In image forming apparatuses such as printers, a fixing device that uses a heat fixing method fixes toner to a recording sheet in the following way. For example, a pressing roller, which acts as a pressing member, is pressed against the circumferential surface of a rotating fixing roller by the restorative force of an elastic member such as a compression spring, thereby forming a fixing nip. A recording sheet carrying a toner image is passed through this fixing nip in order to fix the toner image to the recording sheet.

The outermost surface of the pressing roller is typically an elastic layer formed from silicone rubber or fluorinated resin. A portion of the elastic layer elastically deforms in order to form the fixing nip. As a result, if the pressing roller is continually pressed against the fixing roller, the portion of the elastic layer that elastically deforms may not fully return to its original shape if a long time passes without any images being formed. Such a change in shape would prevent smooth transport of recording sheets.

One way of addressing this problem is to provide a switching mechanism (a switching unit) that switches the pressing roller and the fixing roller between a separation state, in which the pressing roller and the fixing roller are not in contact, and a pressing state in which the pressing roller presses against the fixing roller. The switching mechanism places the pressing roller and the fixing roller in the separation state by resisting the restorative force of the elastic member during any time other than image formation (fixing) and places the pressing roller and the fixing roller in the pressing state by allowing the restorative force to act during image formation.

The switching mechanism may, for example, include a plate cam and operate by receiving the rotational power of a motor transmitted over a power transmission mechanism that includes a gear train or the like. The circumferential surface of the plate cam abuts a frame or the like that supports the pressing roller. As the plate cam rotates, the pressing roller is separated from the fixing roller, against the restorative force of the elastic member, or is returned to a position so as to press against the fixing roller.

There is a desire to reduce the cost of all manufactured goods, and image forming apparatuses are no exception. In particular, there is a desire to reduce the cost of the fixing device, which is relatively high as compared to other components of an image forming apparatus.

One approach that has been examined to reduce costs is to reduce the number of motors by one by using the same motor as both the motor for the switching mechanism and the rotary drive motor for the fixing roller. Hereinafter, the motor shared by the fixing roller and the switching mechanism is referred to as a shared motor.

For example, a clutch may be incorporated in the power transmission mechanism between the shared motor and the cam (switching mechanism), and rotation of the cam can be controlled by engaging and disengaging the clutch before and after a series of image forming operations.

Such a structure, however, causes the following problems to arise.

When separating the pressing roller, the shared motor must bear not only the load for compressing the compression spring, but also the load for rotary driving of the fixing roller. As a result, a shared motor with a high torque must be used, which increases the size of the motor, thus increasing the size of the fixing device.

In order to address this problem, the load (torque) on the shared motor can be reduced when the shared motor separates the pressing roller (i.e. compresses the compression spring) by setting a high reduction ratio for the power transmission mechanism. Setting the reduction ratio to be high, however, slows down rotation of the cam, causing an increase in the time necessary to return the pressing roller to the pressing state (in which the pressing roller presses against the fixing roller). The result is a longer time before image forming (fixing) begins for the first sheet being printed.

SUMMARY OF THE INVENTION

A fixing device according to one aspect of the present invention is a fixing device comprising: a heating rotating body driven by a motor; a pressing member; a biasing unit configured to place the pressing member and the heating rotating body in a first state by pressing the pressing member and the heating rotating body together with a biasing force so as to form a nip through which a recording sheet with a toner image formed thereon passes; a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together; a power transmission mechanism configured to transmit the rotational power of the motor to the switching unit; and a transmission control unit configured to establish and cut off the transmission of the rotational power of the motor to the switching unit by the power transmission mechanism, wherein the power transmission mechanism uses one of a first transmission path and a second transmission path for the transmission of rotational power, a reduction ratio of the first transmission path being larger than a reduction ratio of the second transmission path, and the transmission control unit includes a path selection unit configured to select the first transmission path when the switching unit switches the pressing member and the heating rotating body from the first state to the second state and to select the second transmission path when the switching unit switches the pressing member and the heating rotating body from the second state to the first state.

An image forming device to another aspect of the present invention is an image forming apparatus that forms an image on a recording sheet by electrophotography and includes a fixing device that fixes a toner image to a recording sheet on which the toner image is formed, the fixing device comprising: a heating rotating body driven by a motor; a pressing member; a biasing unit configured to place the pressing member and the heating rotating body in a first state by pressing the pressing member and the heating rotating body together with a biasing force so as to form a nip through which a recording sheet with a toner image formed thereon passes; a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together; a power transmission mechanism configured to transmit the rotational power of the motor to the switching unit; and a transmission control unit configured to establish and cut off the transmission of the rotational power of the motor to the switching unit by the power transmission mechanism, wherein the power transmission mechanism uses one of a first transmission path and a second transmission path for the transmission of rotational power, a reduction ratio of the first transmission path being larger than a reduction ratio of the second transmission path, and the transmission control unit includes a path selection unit configured to select the first transmission path when the switching unit switches the pressing member and the heating rotating body from the first state to the second state and to select the second transmission path when the switching unit switches the pressing member and the heating rotating body from the second state to the first state.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

With reference to the drawings, the following describes a fixing device, and an image forming apparatus provided with the fixing device, according to aspects of the present invention.

Embodiment 1

Figure 1:
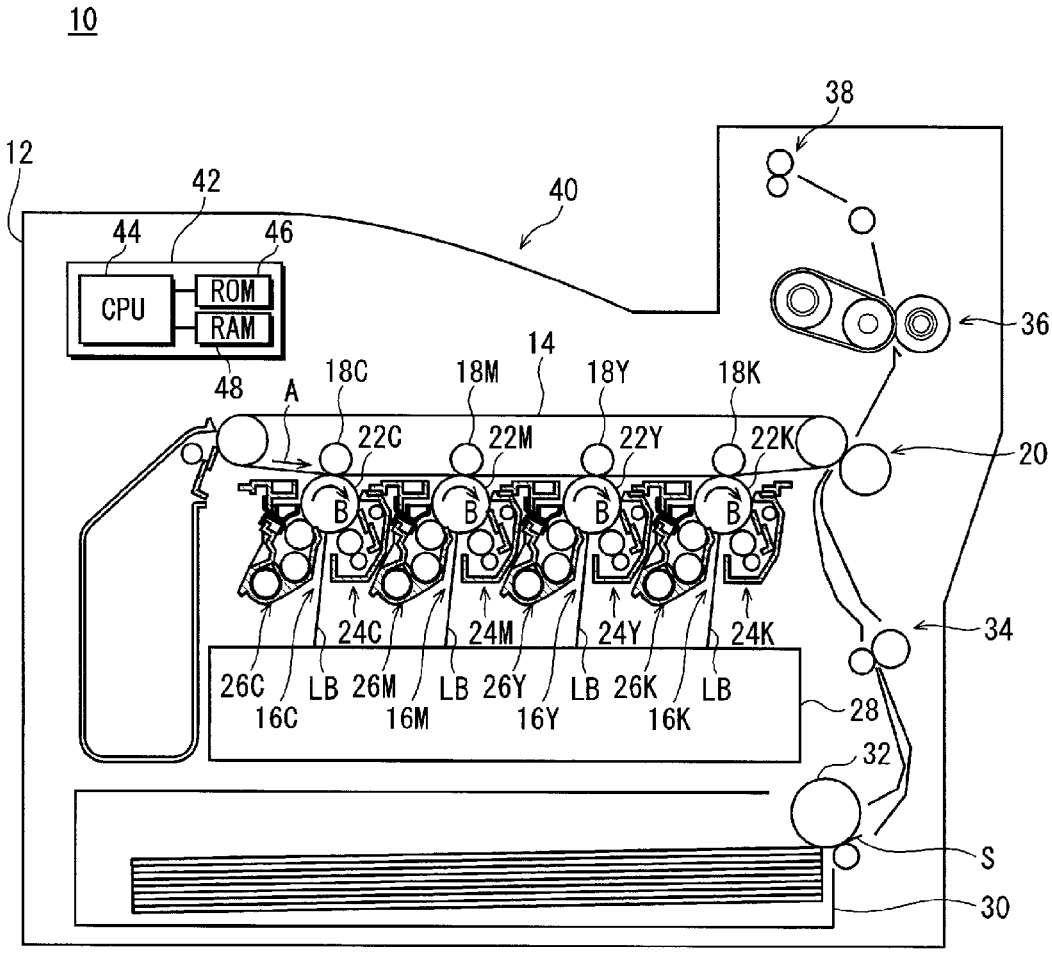
FIG. 1 illustrates the structure of a tandem-type printer according to Embodiment 1.

FIG. 1 illustrates the structure of a tandem-type printer 10 (hereinafter simply referred to as a "printer 10") according to Embodiment 1. While the example of a printer is described here, the present invention is also applicable to other image forming apparatuses such as copiers, facsimile machines, and so forth.

The printer 10 is an image forming apparatus that adopts the so-called intermediate transfer method. As shown in FIG. 1, the printer 10 includes a transfer belt 14 that is provided horizontally within a housing 12 and that moves in the direction of the arrow A; four imaging units 16C, 16M, 16Y, and 16K provided in series along the direction of movement of the transfer belt 14; primary transfer rollers 18C, 18M, 18Y, and 18K that correspond to the imaging units; and a secondary transfer unit 20. Toner images of various colors formed by the imaging units 16C, 16M, 16Y, and 16K are overlaid on the transfer belt 14 and then transferred to a recording sheet S to form a color image.

The central components of the four imaging units 16C, 16M, 16Y, and 16K are respective photoconductive drums 22C, 22M, 22Y, and 22K that act as image carriers. The imaging units 16C, . . . , 16K also include respective charging units 24C, 24M, 24Y, and 24K provided by the respective photoconductive drums 22C, . . . , 22K and respective developing units 26C, 26M, 26Y, and 26K. An exposure unit 28 is provided below the imaging units 16C, . . . , 16K and emits optically modulated laser beams LB towards the photoconductive drums 22C, . . . , 22K. The surfaces of the photoconductive drums 22C, . . . , 22K, which rotate in the direction of the arrow B, are charged uniformly by the charging units 24C, . . . , 24K and exposed to the laser beams LB to form electrostatic latent images thereon. The electrostatic latent images are developed as toner images by the developing units 26C, . . . , 26K. Note that the developing units 16C, . . . , 16K correspond to the color component of the optically modulated laser light in order to provide the photoconductive drums 22C, . . . , 22K with developer in the form of C (cyan), M (magenta), Y (yellow), and K (black) toner.

The toner images formed on the photoconductive drums 22C, . . . , 22K are affected by the electrical field produced between the primary transfer rollers 18C, . . . , 18K, and the photoconductive drums 22C, . . . , 22K so as to be transferred successively to the moving transfer belt 14.

A recording sheet S is picked up from a paper cassette 30 by a pickup roller 32 and is transported by a pair of resist rollers 34 so as to arrive at the secondary transfer unit 20 at the same time as the toner images on the transfer belt 14. The secondary transfer unit 20 transfers the toner images that have been overlaid on one another on the transfer belt 14 to the recording sheet.

The toner images on the recording sheet S are fixed by a fixing device 36, and the recording sheet S is then ejected into a discharge tray 40 by a pair of discharge rollers 38.

The printer 10 also includes a controller 42. The controller 42 includes a CPU 44 connected to a ROM 46 and a RAM 48. The CPU 44 executes control programs stored in the ROM 46 to perform smooth image forming operations through comprehensive control of the above-described units and devices.

Figure 2:
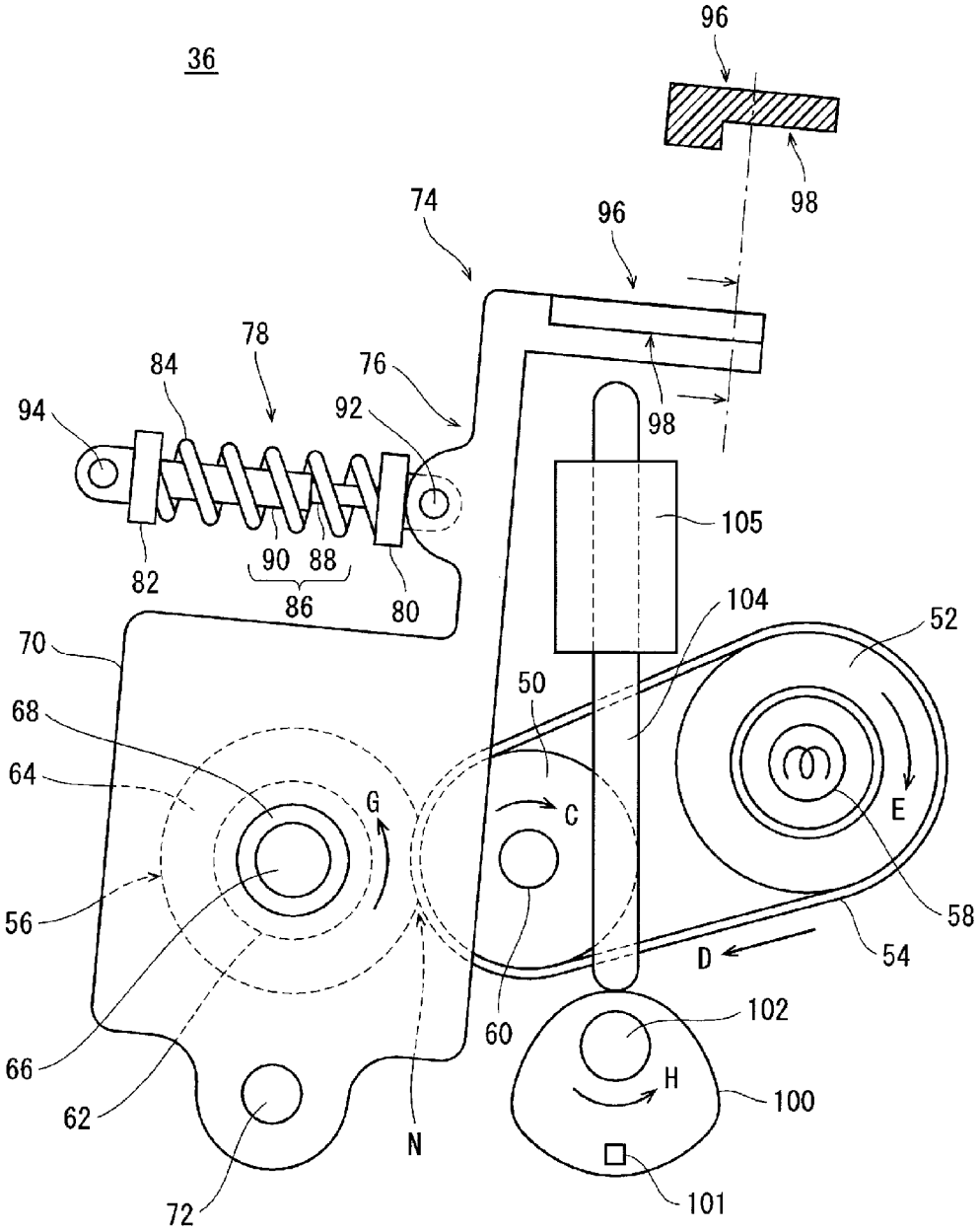
FIG. 2 is a front view of a portion of the fixing device according to Embodiment 1, illustrating a state in which the pressing roller is pressed against the fixing belt.

FIG. 2 is a front view of a portion of the structure of the fixing device 36.

The fixing device 36 adopts a thermal belt fixing method and includes a fixing roller 50, a heat roller 52, a fixing belt 54 stretched between the fixing roller 50 and the heat roller 52, and a pressing roller 56.

The heat roller 52 is formed from a metal tube member. A heater lamp 58 is provided as a heat source inside the hollow portion of the tube member. Both edges of both the fixing roller 50 and the heat roller 52 are rotatably supported via bearings by a support member (neither the bearings nor the support member being shown in the figures).

A spur gear 120 (shown in FIG. 4, not in FIG. 2), described below, is attached to a metal core 60 of the fixing roller 50 and is rotated in the direction shown by the arrow C with a motor 106 (FIG. 5) as the source of rotational power. The fixing belt 54 thus rotates in the direction shown by the arrow D, thereby causing the heat roller 52 to rotate in the direction shown by the arrow E.

The pressing roller 56 is formed by a metal core 62 with an elastic layer 64 formed from silicone rubber or fluorinated resin on the outer circumferential surface thereof. The metal core 62 has an overall cylindrical shape. The elastic layer 64 is formed at a central region of the metal core 62, and at both ends of the central region, the metal core 62 has reduced diameter portions 66 with a smaller diameter than the central region. One reduced diameter portion 66 of the pressing roller 56 is axially supported, via a bearing 68, by a swing plate 70 that is a support member of the pressing roller 56.

The swing plate 70 is a metal plate. The thickness of the swing plate 70 is uniform in a direction perpendicular to the plane of FIG. 2. The swing plate 70 is attached to a shaft 72, whose direction of length is perpendicular to the plane of FIG. 2, and can swing about the central axis of the shaft 72. The shaft 72 is fixed to a housing not shown in the figures.

The swing plate 70 includes an L-shaped lever 74 at the opposite side of the shaft 72 from the bearing 68.

One end of a spring unit 78 is attached to a first straight portion 76 of the lever 72. The spring unit 78 includes a pair of holders 80 and 82 disposed opposite each other and a compression coil spring 84 (hereinafter referred to as a "compression spring 84") between the holders 80 and 82. The compression spring 84 is an elastic member and acts as a biasing unit. The holders 80 and 82 are connected by a linear guide mechanism 86 that linearly guides both of the holders 80 and 82. The linear guide mechanism 86 is composed of a piston 88 and a cylinder 90.

The holder 80 is attached to the first straight portion 76 by a pin 92. The holder 80 is attached so as to rotate freely about the central axis of the pin 92 with respect to the first straight portion 76 (swing plate 70).

The holder 82 at the other end of the spring unit 78 is attached to a pin 94 whose direction of length is perpendicular to the plane of FIG. 2. The holder 82 rotates freely about the central axis of the pin 94. The pin 94 is fixed to a housing not shown in the figures.

The upper half of a second straight portion 96 of the lever 74 extends out from the plane of FIG. 2 at approximately a right angle, as illustrated by the local cross-section diagram in FIG. 2. The bottom surface of this extended portion forms a contact surface 98 for the tip of a bar 104 that is described below.

Note that the end of the pressing roller 56 towards the back of FIG. 2 is supported axially, via a bearing (not shown in the figures), by a swing plate (not shown in the figures) that, other than not having a lever 74, is similar to the swing plate 70.

FIG. 2 shows the compression spring 84, which is a biasing unit, pressing against the swing plate 70 (first straight portion 76) due to the restorative force of the compression spring 84, the restorative force thus acting as a biasing force. The restorative force acts on the pressing roller 56 attached to the swing plate 70 to press the pressing roller 56 into contact with the fixing roller 50. The elastic layer 64 of the pressing roller 56 elastically deforms, thus forming the fixing nip N. During image formation (during fixing operations), the pressing roller 56 is thus pressed into contact with the fixing roller 50 (with the fixing belt 54 therebetween). The pressing roller 56 is thus caused to rotate in the direction of the arrow G In this way, the pressing roller 56 is pressed against the fixing belt 54 during image forming operations, as shown in FIG. 2. When image forming operations are not being performed, the pressing roller 56 is separated from the fixing belt 54. If the pressing roller 56 is continually pressed against the fixing belt 54, the portion of the elastic layer that elastically deforms may not fully return to its original shape if a long time passes without any images being formed. Such a change in shape would prevent smooth transport of recording sheets.

Next, a mechanism for separating the pressing roller 56 from the fixing belt 54 is described.

A plate cam 100, which is an eccentric member, is provided below the contact surface 98 of the second straight portion 96 in the swing plate 70. The plate cam 100 is attached to a cam shaft 102 whose direction of length is perpendicular to the plane of FIG. 2. The cam shaft 102 is rotated in the direction of the arrow H by a motor 106, described below, via a power transmission mechanism, also described below. The plate cam 100 is integrally formed with the cam shaft 102 and therefore also rotates about the central axis of the cam shaft 102.

The bar 104 has a circular cross-section and is supported above the plate cam 100 by a linear bearing 105 so as to slide up and down freely. The bar 104 lowers due to its own weight, and the bottom of the bar 104 is continually in contact with the circumferential surface of the plate cam 100. The linear bearing 105 is attached to a housing not shown in the figures.

In the above structure, when the plate cam 100 is rotated from a state in which the rotational position of the plate cam 100 is at lower dead center, as illustrated in FIG. 2, the bottom of the bar 104 follows the outer circumferential surface of the plate cam 100, causing the bar 104 to slide upwards and the top of the bar 104 to come into contact with the contact surface 98. Further rotation of the plate cam 100 causes the bar 104 to push the contact surface 98 upwards and act against the restorative force of the compression spring 84 so that the swing plate 70 rotates counter-clockwise around the central axis of the shaft 72.

Figure 3:
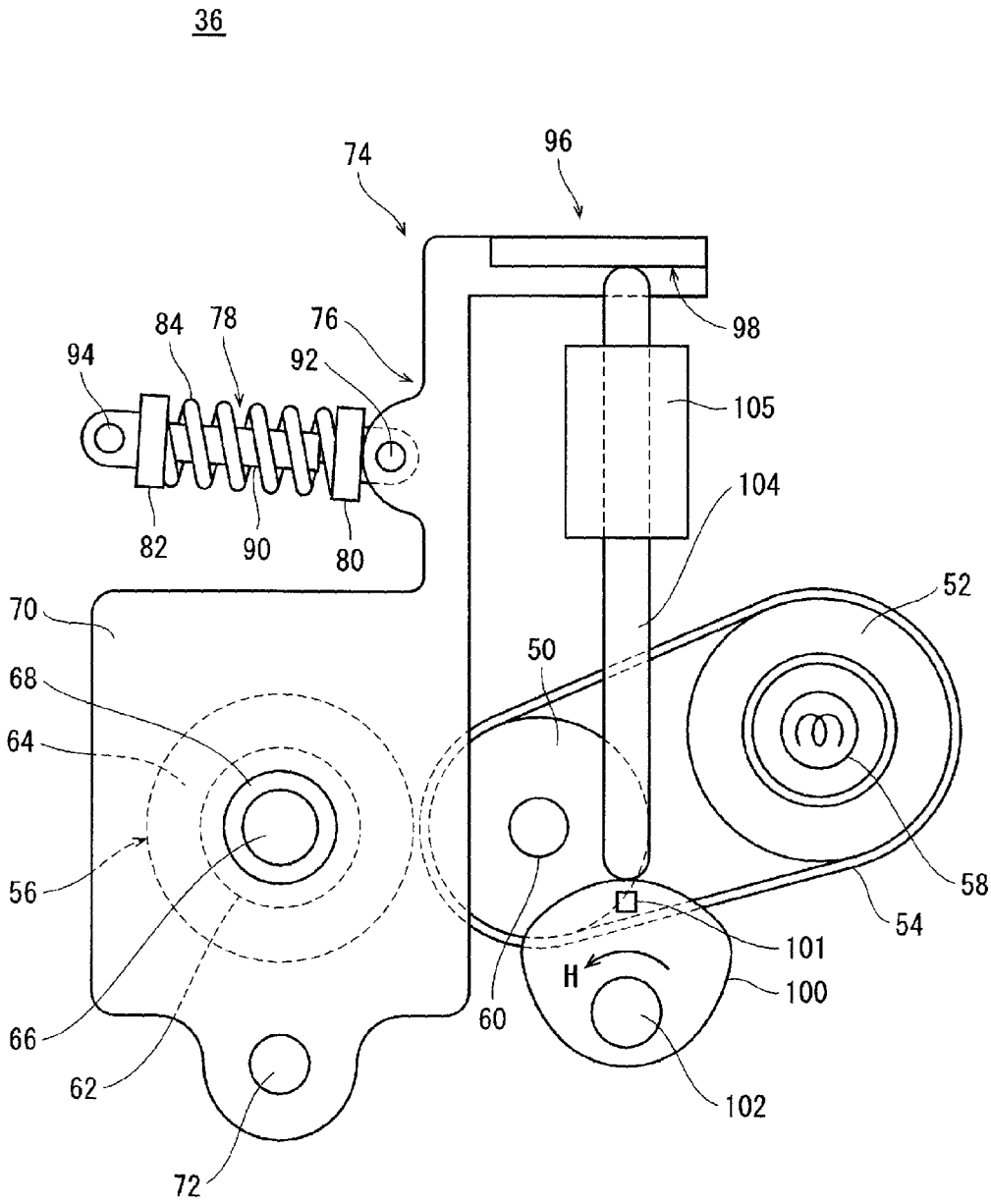
FIG. 3 is a front view of a portion of the fixing device according to Embodiment 1, illustrating a state in which the pressing roller is separated from the fixing belt.

As shown in FIG. 3, when the rotational position of the plate cam 100 is at upper dead center, the swing plate 70 is rotated a maximum amount toward the left, causing the pressing roller 56 to separate from the fixing roller 50. In this state, the compression spring 84 is in a maximum state of compression and thus has a maximum stored amount of elastic energy.

A reflecting seal 101 is adhered to the side of the plate cam 100 near a position farthest from the central axis of the cam shaft 102. The reflecting seal 101 is for detecting whether the plate cam 100 is at upper dead center or lower dead center. A lower dead center sensor 142 (not shown in FIG. 2 or 3) is provided for detecting the reflecting seal 101 when the plate cam 100 is at lower dead center, as illustrated in FIG. 2, and an upper dead center sensor 144 (not shown in FIG. 2 or 3) is provided for detecting the reflecting seal 101 when the plate cam 100 is at upper dead center, as illustrated in FIG. 3 (see FIG. 6). A reflective photo sensor is used for the lower dead center sensor 142 and the upper dead center sensor 144.

The cam shaft 102, the plate cam 100, the bar 104, the linear bearing 105, the swing plate 70, the shaft 72, and the bearing 68 thus constitute a switching unit that causes the pressing roller 56 and the fixing belt 54 to come into contact or to separate, thereby changing between a separated state (FIG. 3) when the pressing roller 56 and the fixing belt 54 are separated and a pressing state (FIG. 2) when the pressing roller 56 is acted on by the restorative force of the compression spring 84 and thus caused to press against the fixing belt 54.

Next, the structure for causing the fixing roller 50 and the fixing belt 54 to rotate, as well as the structure for causing the plate cam 100 (the cam shaft 102) to rotate, are described with reference to FIGS. 4 and 5.

Figure 4:
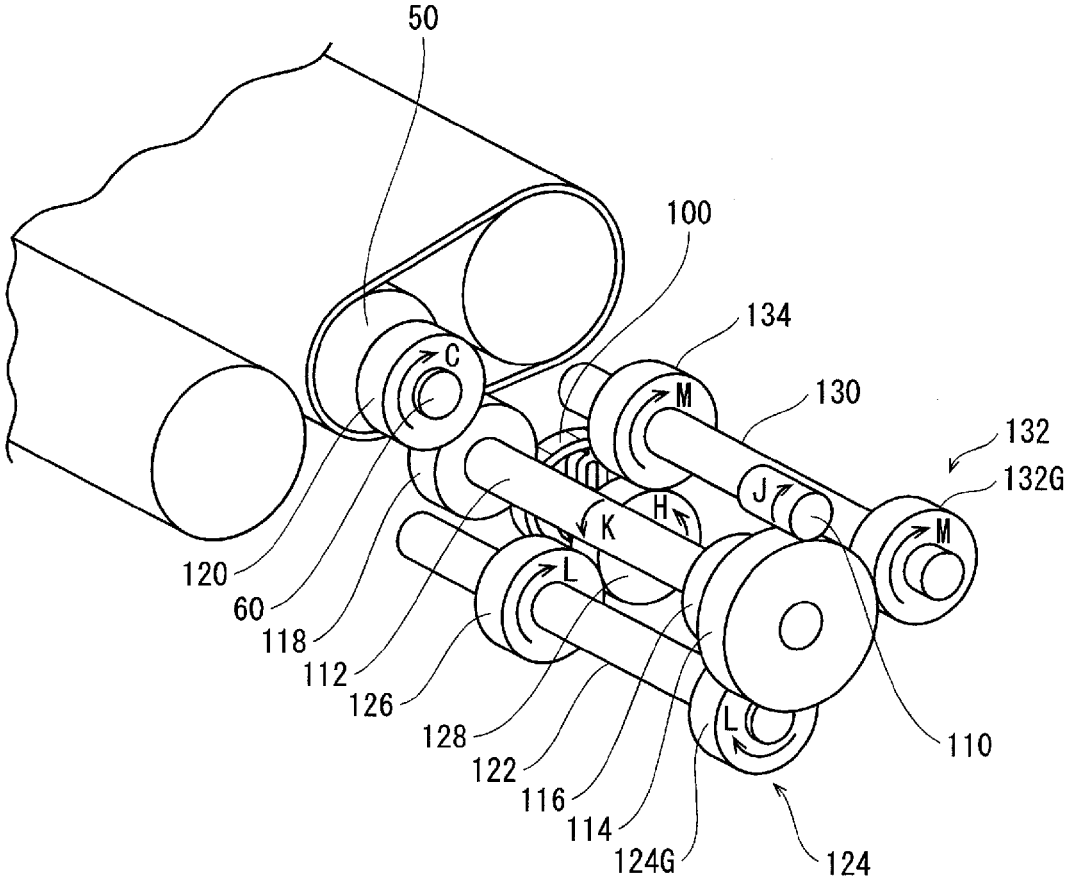
FIG. 4 is a perspective view of the fixing device according to Embodiment 1, illustrating a portion of the structure of a mechanism for transmitting power from a motor to a fixing roller and a plate cam.

FIG. 4 is a perspective view illustrating the structure of a mechanism for transmitting power from the motor 106 (not shown in FIG. 4; see FIG. 5) to the fixing roller 50 and a mechanism for transmitting power from the motor 106 to the plate cam 100 (the cam shaft 102). FIG. 5 illustrates power transmission paths in the above two power transmission mechanisms.

Figure 5:
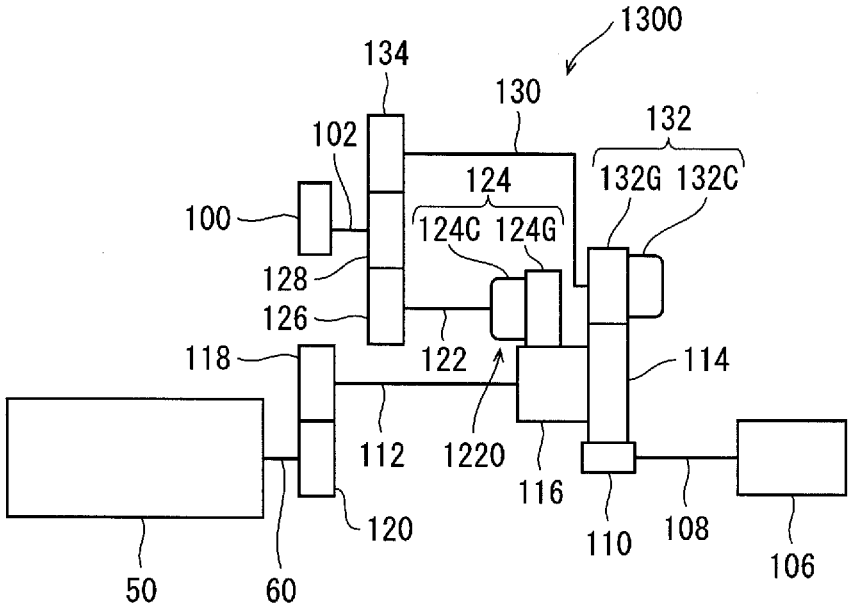
FIG. 5 illustrates power transmission paths in the power transmission mechanism.

Note that the teeth of the spur gear or the like in FIG. 4 and FIG. 5 are omitted from the figures for the sake of convenience, with the spur gear being depicted as a cylinder. Furthermore, the clutch portion of a micro electromagnetic clutch with gears (i.e. a micro electromagnetic clutch, hereinafter referred to simply as an "electromagnetic clutch") is omitted from FIG. 4 to avoid an unnecessary degree of complication. In FIG. 5, the shaft (axis) to which gears or the like are attached is represented as a straight line for the sake of convenience.

First, the mechanism for transmitting power from the motor 106 to the fixing roller 50 is described.

A spur gear 110 is attached to the end of an output shaft 108 of the motor 106. In the two power transmission mechanisms, the spur gear 110 is the gear with the smallest diameter and with the fewest number of teeth.

A shaft 112 is provided parallel to the central axis of the output shaft 108. A spur gear 114 and a spur gear 116 are attached in series to one end of the shaft 112. The spur gear 114 is engaged with a spur gear 110 that is attached to the output shaft 108 of the motor 106. The diameter of the spur gear 114 is larger than the diameter of the spur gear 116, and the number of teeth of the spur gear 114 is greater. The spur gears 114 and 116 are both attached along the same axis (the shaft 112) to form a double gear structure.

A spur gear 118 is attached to the other end of the shaft 112, and a spur gear 120 is attached to an end of a metal core 60 of a fixing roller 50. The spur gears 118 and 120 are engaged.

With the structure described thus far, when the motor 106 is started, the output shaft 108 rotates, rotating the spur gear 110 in the direction shown by the arrow J in FIG. 4. The spur gear 114, which is engaged with the spur gear 110, rotates in the direction of the arrow K, as do the shaft 112 to which the spur gear 114 is attached and the spur gear 118 attached to the shaft 112. The spur gear 120, which is engaged with the spur gear 118, rotates in the direction of the arrow C, as does the fixing roller 50, since the spur gear 120 is attached to the metal core 60 thereof. The starting and stopping of rotation of the fixing roller 50 is dependent on the motor 106 being turned on and off.

Next, the mechanism for transmitting power from the motor 106 to the plate cam 100 (cam shaft 102) is described.

A shaft 122 is provided parallel to the shaft 112. An electromagnetic clutch 124 is attached to one end of the shaft 122. A spur gear 124G of the electromagnetic clutch 124 is engaged with the spur gear 116. Using a clutch 124C, the electromagnetic clutch 124 transmits or blocks power between the spur gear 124G and the shaft 122.

A spur gear 126 is attached to the other end of the shaft 122. The spur gear 126 is engaged with a spur gear 128 attached to the opposite end of the cam shaft 102 than the plate cam 100.

Another shaft 130 is provided parallel to the shaft 112. An electromagnetic clutch 132 is attached to one end of the shaft 130. A spur gear 132G of the electromagnetic clutch 132 is engaged with the spur gear 114. Using a clutch 132C, the electromagnetic clutch 132 transmits or blocks power between the spur gear 132G and the shaft 130.

A spur gear 134 is attached to the other end of the shaft 130. The spur gear 134 is engaged with the spur gear 128 attached to the cam shaft 102.

The spur gears 124G, 126, 132G, and 134 provided at the tips of the shafts 122 and 130 all have the same diameter and number of teeth.

In the above structure, by selectively engaging one of the clutch 124C and the clutch 132C, power from the motor 106 is transmitted across the path of either the shaft 122 or the shaft 130, so that the plate cam 100 rotates.

For example, if the clutch 124C is engaged while the motor 106 is rotating, power will be transmitted to the shaft 122 by the spur gear 124G, which is engaged with the spur gear 116 and rotates in the direction of the arrow L. The spur gear 126 attached to the shaft 122 will also therefore rotate in the direction of the arrow L. The spur gear 128, which is engaged with the spur gear 126, will rotate in the direction of the arrow H, so that the plate cam 100 also rotates in the direction of the arrow H.

If, on the other hand, the clutch 132C is engaged, power will be transmitted to the shaft 130 by the spur gear 132G, which is engaged with the spur gear 114 and rotates in the direction of the arrow M. The spur gear 134 attached to the shaft 130 will also therefore rotate in the direction of the arrow M. The spur gear 128, which is engaged with the spur gear 134, will rotate in the direction of the arrow H, so that the plate cam 100 also rotates in the direction of the arrow H.

As described above, the mechanism for transmitting power from the output shaft 108 of the motor 106 to the cam shaft 102 splits partway through into two power transmission paths.

In the mechanism for transmitting power from the output shaft 108 of the motor 106 to the cam shaft 102, a path in which the clutch 124C is engaged and power is transmitted by the spur gear 116, the spur gear 124G, the shaft 122, and the spur gear 126 is referred to as a first power transmission path 1220, and a path in which the clutch 132C is engaged and power is transmitted by the spur gear 114, the spur gear 132G, the shaft 130, and the spur gear 134 is referred to as a second power transmission path 1300.

In the above case, the reduction ratio from the spur gear 110, attached to the output shaft 108 of the motor 106, to the spur gear 128, attached to the cam shaft 102, is smaller in the second power transmission path 1300 than in the first power transmission path 1220, due to a difference in the number of teeth of the spur gear 114 and the spur gear 116.

Therefore, the plate cam 100 rotates faster when rotated via the second power transmission path 1300 than when rotated via the first power transmission path 1220. Conversely, the first power transmission path 1220 allows for rotation of the plate cam 100 with a greater toque than the second power transmission path 1300.

In the mechanism for transmitting power from the output shaft 108 of the motor 106 to the cam shaft 102, let (i) the reduction ratio in the case of the first power transmission path 1220 be Ra1 and the reduction ratio in the case of the second power transmission path 1300 be Ra2, (ii) the rotation speed of the plate cam 100 in the case of the first power transmission path 1220 be Sa1 and the rotation speed of the plate cam 100 in the case of the second power transmission path 1300 be Sa2, assuming the same speed of revolution of the motor 106, and (iii) the torque acting on the cam shaft 102 in the case of the first power transmission path 1220 be Ta1 and the torque acting on the cam shaft 102 in the case of the second power transmission path 1300 be Ta2. The magnitudes of these values compare as follows.

$$Ra1>Ra2, Sa1<Sa2, Ta1>Ta2$$

In the present embodiment, when the pressing roller 56 is caused to press against the fixing belt 54, i.e. when the plate cam 100 is rotated from upper dead center in FIG. 3 to lower dead center in FIG. 2, the second power transmission path 1300 is used. This is because in this case, it is necessary to rotate the plate cam 100 quickly in order to complete the pressing operation and begin image formation for the first recording sheet rapidly. At the same time, since the compression spring 84 tends to extend, the swing plate 70 hardly bears the load (torque) for rotating the plate cam 100.

Conversely, when the pressing roller 56 is caused to separate from the fixing roller 50, i.e. when the plate cam 100 is rotated from lower dead center in FIG. 2 to upper dead center in FIG. 3, the first power transmission path 1220 is used. This is because in this case, a large torque is necessary to rotate the swing plate 70 against the elastic force of the compression spring 84. At the same time, since the separating operation is performed after a series of image formation operations, it poses no problem for the separating operation to require a relatively longer time.

Figure 6:
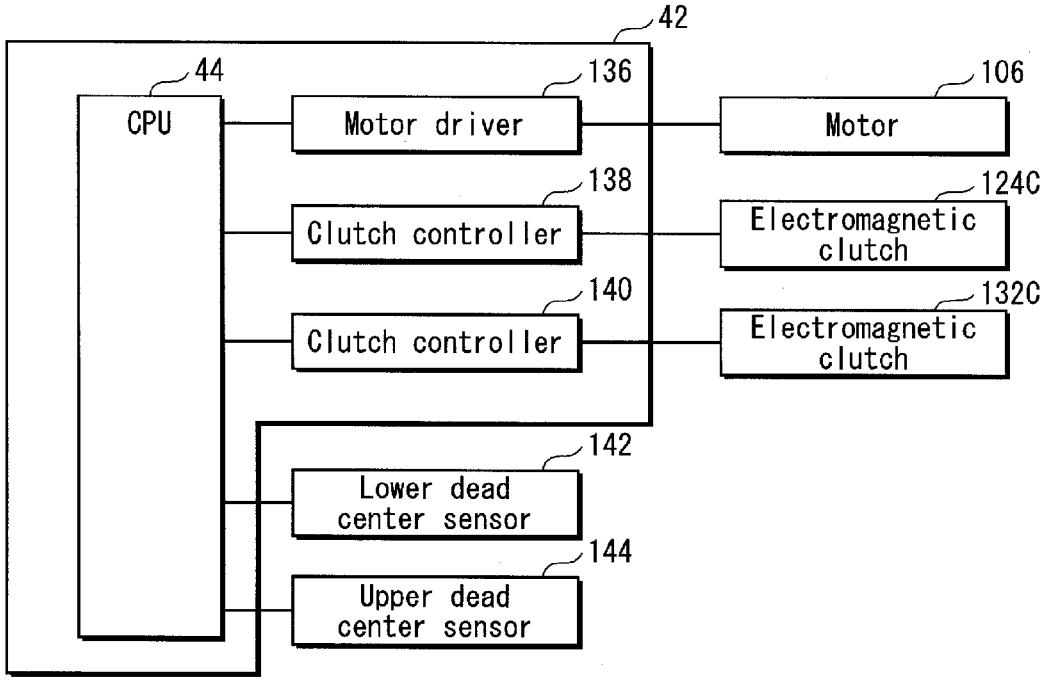
FIG. 6 is a block diagram illustrating a portion of the structure of a controller for the printer, specifically the portion related to controlling rotation of the motor and to controlling rotation of the plate cam.

The CPU 44 of the controller 42 performs rotation control of the motor 106 and rotation control of the plate cam 100. FIG. 6 is a block diagram showing the structure related to both forms of rotation control.

As shown in FIG. 6, the CPU 44 is connected to a motor driver 136 that controls driving of the motor 106 (FIG. 5), a clutch controller 138 that engages and disengages the electromagnetic clutch 124C (FIG. 5), a clutch controller 140 that engages and disengages the electromagnetic clutch 132C (FIG. 5), the lower dead center sensor 142, and the upper dead center sensor 144.

Figure 7:
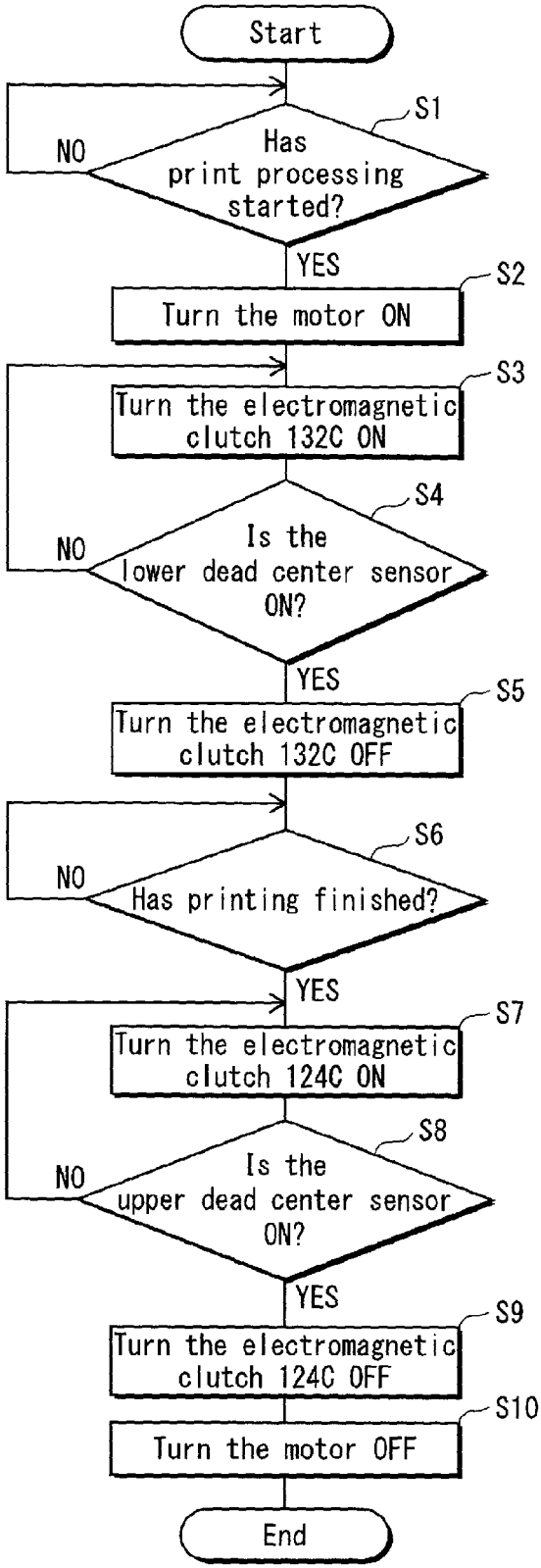
FIG. 7 is a flowchart of a control program executed by the controller of the fixing device according to Embodiment 1.

The control program that the CPU 44 executes to control the motor and clutches is described with reference to the flowchart in FIG. 7. Note that before the program runs, the motor 106 is stopped, and the electromagnetic clutches 132C and 124C are both disengaged. Furthermore, the plate cam 100 is at upper dead center.

When a print job is received from an external device and print processing (image formation processing) begins (step S1: YES), the CPU 44 starts the motor 106 (step S2) and engages the electromagnetic clutch 132C (step S3). As a result, the fixing roller 50 rotates, causing the plate cam 100 to rotate via the second power transmission path 1300. As described above, the pressing operation to press the pressing roller 56 against the fixing roller 50 thus begins.

As long as the lower dead center sensor 142 does not turn on (step S4: NO), the electromagnetic clutch 132C stays engaged so as to rotate the plate cam 100. When the lower dead center sensor 142 detects the reflecting seal 101 and turns on (step S4: YES), the pressing operation to press the pressing roller 56 against the fixing roller 50 is considered to be complete. The CPU 44 therefore disengages the electromagnetic clutch 132C (step S5) to stop rotating the plate cam 100.

During printing, i.e. during image formation (step S6: NO), the CPU 44 maintains the current conditions, namely operation of the motor 106 and disengagement of the electromagnetic clutches 132C and 124C. Once the print operations are complete (step S6: YES), the CPU 44 engages the electromagnetic clutch 124C (step S7), causing the plate cam 100 to rotate via the first power transmission path 1220. The separating operation to separate the pressing roller 56 from the fixing roller 50 thus begins.

As long as the upper dead center sensor 144 does not turn on (step S8: NO), the electromagnetic clutch 124C stays engaged so as to rotate the plate cam 100. When the upper dead center sensor 144 detects the reflecting seal 101 and turns on (step S8: YES), the separating operation to separate the pressing roller 56 from the fixing roller 50 is considered to be complete. The CPU 44 therefore disengages the electromagnetic clutch 124C (step S9) to stop rotating the plate cam 100. The CPU 44 then stops the motor 106 (step S10), and the program terminates.

With the above structure, the fixing device 36 of Embodiment 1 achieves both rotation of the fixing roller 50 and pressing/separation of the pressing roller 56 and the fixing belt 54 with a single motor 106. Moreover, while pressing the pressing roller 56 against the fixing belt 54, the plate cam 100 (cam shaft 102) is rotated via the second power transmission path 1300, which has a lower reduction ratio, thereby shortening the time until completion of the pressing operation. Conversely, when separating the pressing roller 56 from the fixing belt 54, the plate cam 100 is rotated via the first power transmission path 1220, which has a higher reduction ratio, in order to achieve the torque necessary to compress the compression spring 84 (i.e. to store elastic energy). This selective use of power transmission paths prevents the motor from becoming unnecessarily large.

Embodiment 2

In Embodiment 1, two electromagnetic clutches 124C and 132C are used in the mechanism for transmitting power from the motor 106 to the plate cam 100 (cam shaft 102). By contrast, in Embodiment 2, only one electromagnetic clutch is used in the power transmission mechanism.

The fixing device of Embodiment 2 has a substantially similar structure to the fixing device 36 of Embodiment 1, except for the difference in the structure of the mechanism for transmitting power from the motor 106 to the cam shaft 102. Accordingly, similar portions are labeled with the same numbers as in Embodiment 1, and a description thereof is either omitted or simplified. The following focuses mainly on the differences.

Figure 8:
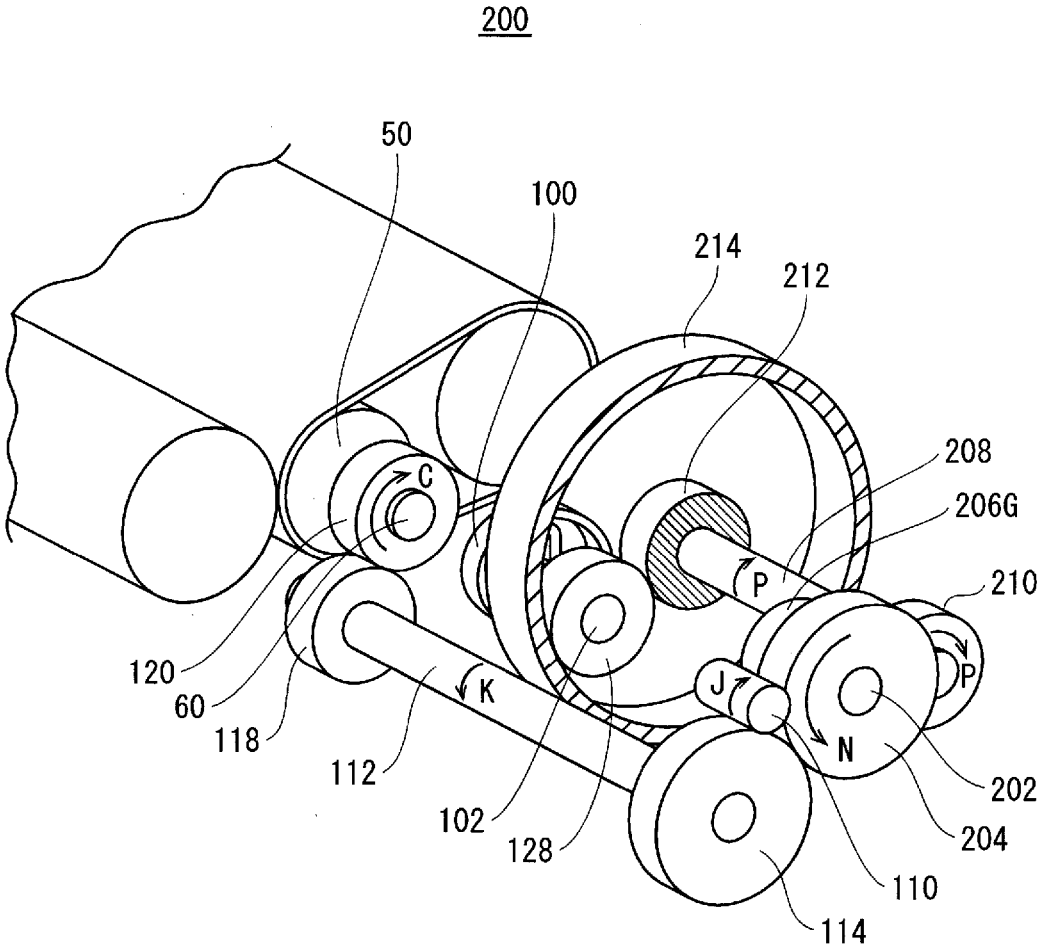
FIG. 8 is a perspective view of the fixing device according to Embodiment 2, illustrating a portion of the structure of a mechanism for transmitting power from a motor to a fixing roller and a plate cam.
Figure 9:
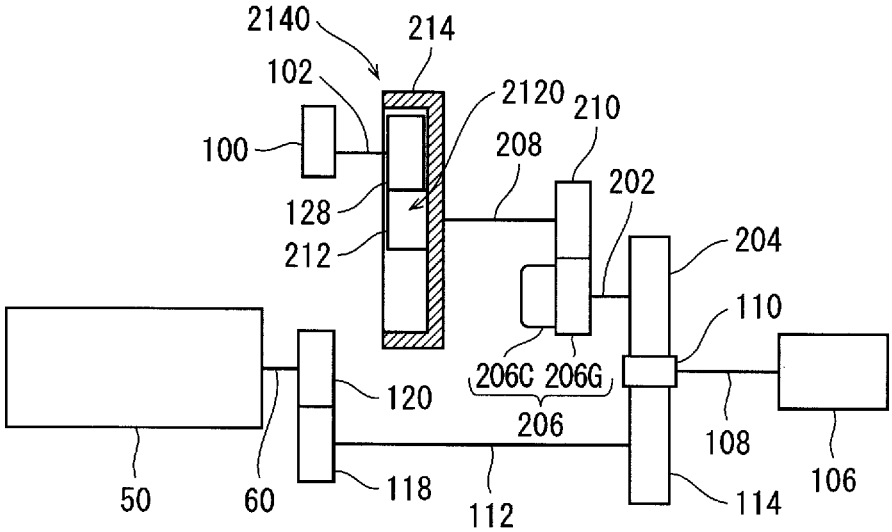
FIG. 9 illustrates power transmission paths in the power transmission mechanism.

FIG. 8 is a perspective view of a fixing device 200 in Embodiment 2, showing the structure of a mechanism for transmitting power from the motor 106 (not shown in FIG. 8; see FIG. 9) to the fixing roller 50, as well as the structure of a mechanism for transmitting power from the motor 106 to the plate cam 100 (cam shaft 102). FIG. 9 shows the power transmission path in each of the power transmission mechanisms. FIGS. 8 and 9 are drawn similarly to FIGS. 4 and 5 respectively.

First, the mechanism for transmitting power from the motor 106 to the fixing roller 50 is described. This mechanism is similar to Embodiment 1.

Namely, a shaft 112 is provided parallel to the central axis of an output shaft 108 of the motor 106. A spur gear 114 is attached to one end of the shaft 112. The spur gear 114 is engaged with a spur gear 110 that is attached to the output shaft 108 of the motor 106.

A spur gear 118 is attached to the other end of the shaft 112, and a spur gear 120 is attached to an end of a metal core 60 of a fixing roller 50. The spur gears 118 and 120 are engaged.

With the structure described thus far, when the motor 106 is started, the output shaft 108 rotates, rotating the spur gear 110 in the direction shown by the arrow J in FIG. 4. The spur gear 114, which is engaged with the spur gear 110, rotates in the direction of the arrow K, as do the shaft 112 to which the spur gear 114 is attached and the spur gear 118 attached to the shaft 112. The spur gear 120, which is engaged with the spur gear 118, rotates in the direction of the arrow C, as does the fixing roller 50, since the spur gear 120 is attached to the metal core 60 thereof. The starting and stopping of rotation of the fixing roller 50 is dependent on the motor 106 being turned on and off.

Next, the mechanism for transmitting power from the motor 106 to the plate cam 100 is described.

A shaft 202 is provided parallel to the central axis of the output shaft 108 (FIG. 9). A spur gear 204 is attached to one end of the shaft 202. The spur gear 204 is engaged with the spur gear 110 that is attached to the output shaft 108 of the motor 106.

An electromagnetic clutch 206 is attached to the other end of the shaft 202. Using a clutch 206C, the electromagnetic clutch 206 transmits or blocks power between a spur gear 206G and the shaft 202.

Furthermore, a shaft 208 is provided parallel to the central axis of the output shaft 108. A spur gear 210 is attached to one end of the shaft 208. The spur gear 210 is engaged with the spur gear 206G A second partially toothed gear 214 is attached to the other end of the shaft 208. The second partially toothed gear 214 is an internal gear in the shape of a shallow cup. A first partially toothed gear 212 is attached to the section of the shaft 208 located within the second partially toothed gear 214. In other words, the first partially toothed gear 212 and the second partially toothed gear 214 are attached along the same axis (shaft 208).

Figure 10:
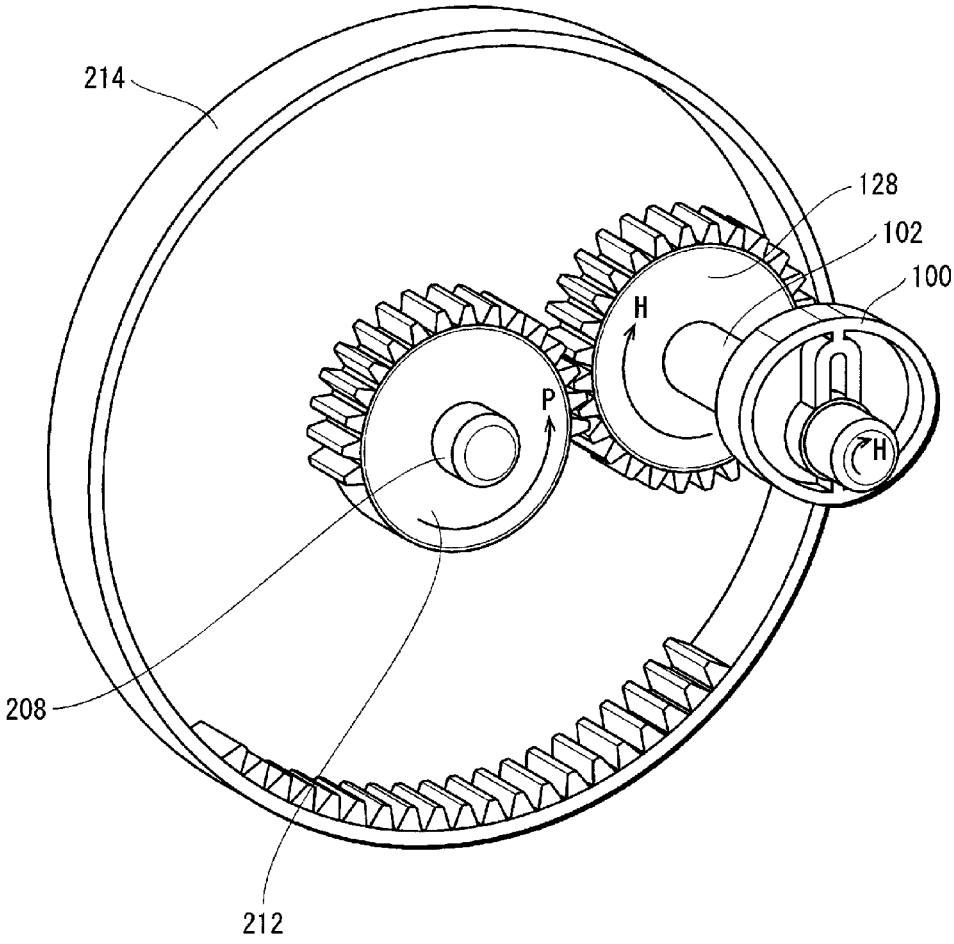
FIG. 10 is a perspective view of a portion of the power transmission mechanism.

FIG. 8 illustrates the cup-shaped second partially toothed gear 214 with the bottom portion thereof cut away. FIG. 10 is a perspective view from the opening side of the second partially toothed gear 214 (i.e. as seen from the opposite side than in FIG. 8).

The first partially toothed gear 212 is a partially toothed spur gear having a section in which no teeth are formed along a certain length in the circumferential direction of the gear. The first partially toothed gear 212 is provided with enough teeth so that one rotation of the first partially toothed gear 212 causes the spur gear 128 attached to the cam shaft 102 to undergo at least one-half of a rotation. The teeth of the first partially toothed gear 212 are provided in a range that allows for rotation of the plate cam 100 from lower dead center to upper dead center.

The second partially toothed gear 214 is a partially toothed spur gear having a section in which no teeth are formed along a certain length in the circumferential direction of the gear. The second partially toothed gear 214 is provided with enough teeth so that one rotation of the second partially toothed gear 214 causes the spur gear 128 attached to the cam shaft 102 to undergo at least one-half of a rotation. Furthermore, the teeth of the second partially toothed gear 214 are provided in a range such that the spur gear 128 does not also engage simultaneously with the first partially toothed gear 212.

Returning to FIGS. 8 and 9, engaging the clutch 206C of the electromagnetic clutch 206 while the motor 106 (FIG. 9) is rotating causes the shaft 208 and the spur gear 206G to connect. Since the spur gear 204 attached to the shaft 208 rotates in the direction of the arrow N, the spur gear 206G also rotates in the direction of the arrow N.

The spur gear 210, which is engaged with the spur gear 206G, rotates in the direction of the arrow P, and the shaft 208 to which the spur gear 210 is attached therefore also rotates in the direction of the arrow P.

Returning to FIG. 10, when the shaft 208 rotates in the direction of the arrow P, the first partially toothed gear 212 and the second partially toothed gear 214 attached thereto also rotate in the direction of the arrow P.

While the spur gear 128 attached to the cam shaft 102 is engaged with the first partially toothed gear 212, the plate cam 100 rotates in the direction of the arrow H from lower dead center to upper dead center. Conversely, while the spur gear 128 is engaged with the second partially toothed gear 214, the plate cam 100 rotates in the direction opposite the arrow H from upper dead center to lower dead center.

As described above, the mechanism for transmitting power from the output shaft 108 of the motor 106 to the cam shaft 102 splits partway through into two power transmission paths.

In the mechanism for transmitting power from the output shaft 108 of the motor 106 to the cam shaft 102, a path in which power is transmitted via the first partially toothed gear 212 is referred to as a first power transmission path 2120, and a path in which power is transmitted via the second partially toothed gear 214 is referred to as a second power transmission path 2140.

In the above case, the reduction ratio from the spur gear 110, attached to the output shaft 108 of the motor 106, to the spur gear 128, attached to the cam shaft 102, is smaller in the second power transmission path 2140 than in the first power transmission path 2120, due to a difference in diameter between the first partially toothed gear 212 and the second partially toothed gear 214.

Therefore, the plate cam 100 rotates faster when rotated via the second power transmission path 2140 than when rotated via the first power transmission path 2120. Conversely, the first power transmission path 2120 allows for rotation of the plate cam 100 with a greater toque than the second power transmission path 2140.

In the mechanism for transmitting power from the output shaft 108 of the motor 106 to the cam shaft 102, let (i) the reduction ratio in the case of the first power transmission path 2120 be Rb1 and the reduction ratio in the case of the second power transmission path 2140 be Rb2, (ii) the rotation speed of the plate cam 100 in the case of the first power transmission path 2120 be Sb1 and the rotation speed of the plate cam 100 in the case of the second power transmission path 2140 be Sb2, assuming the same speed of revolution of the motor 106, and (iii) the torque acting on the cam shaft 102 in the case of the first power transmission path 2120 be Tb1 and the torque acting on the cam shaft 102 in the case of the second power transmission path 2140 be Tb2. The magnitudes of these values compare as follows.

$$Rb1>Rb2, Sb1<Sb2, Tb1>Tb2$$

In Embodiment 2, when the pressing roller 56 is caused to press against the fixing roller 50, i.e. when the plate cam 100 is rotated from upper dead center in FIG. 3 to lower dead center in FIG. 2, the second power transmission path 2140 is used. This is because in this case, as in Embodiment 1, it is necessary to rotate the plate cam 100 quickly in order to complete the pressing operation and begin image formation of the first sheet rapidly. At the same time, since the compression spring 84 tends to extend, the swing plate 70 hardly bears the load (torque) for rotating the plate cam 100.

Conversely, when the pressing roller 56 is caused to separate from the fixing belt 54, i.e. when the plate cam 100 is rotated from lower dead center in FIG. 2 to upper dead center in FIG. 3, the first power transmission path 2120 is used. This is because in this case, as in Embodiment 1, a large torque is necessary to rotate the swing plate 70 against the elastic force of the compression spring 84. At the same time, since the separating operation is performed after a series of image formation operations, it poses no problem for the separating operation to require a relatively longer time.

The CPU 44 (FIG. 1) of the controller 42 performs rotation control of the motor 106 and rotation control of the plate cam 100.

While omitted from the figures, the CPU 44 is connected to the motor driver 136 that controls the motor 106, to the lower dead center sensor 142, and to the upper dead center sensor 144, as in Embodiment 1 (FIG. 6). Furthermore, the CPU 44 is connected to a clutch controller that engages and disengages the electromagnetic clutch 206C (FIG. 9).

The program that the CPU 44 executes to control the motor and the clutch is basically the same as in Embodiment 1, and therefore a description thereof is omitted. Differences are that in the flowchart in FIG. 7 of Embodiment 1, the control to engage and disengage the electromagnetic clutch 132C in steps S3 and S5 the control to engage and disengage the electromagnetic clutch 124C in steps S7 and S9 is replaced with control to engage and disengage the electromagnetic clutch 206C.

With the above structure, the fixing device 200 of Embodiment 2 achieves both rotation of the fixing belt 54 and pressing/separation of the pressing roller 56 and the fixing belt 54 with a single motor 106. Moreover, while pressing the pressing roller 56 against the fixing belt 54, the plate cam 100 is rotated via the second power transmission path 2140, which has a lower reduction ratio, thereby shortening the time until completion of the pressing operation. Conversely, when separating the pressing roller 56 from the fixing belt 54, the plate cam 100 is rotated via the first power transmission path 2120, which has a higher reduction ratio, in order to achieve the torque necessary to compress the compression spring 84 (i.e. to store elastic energy). This selective use of power transmission paths prevents the motor from becoming unnecessarily large.

As can be understood from the description thus far, in the fixing device with the above structure, when the pressing member and the heating rotating body are switched from the first state, in which the pressing member receives the biasing force of the biasing unit and presses against the heating rotating body, to the second state, in which the pressing member and the heating rotating body are separated in resistance to the biasing force of the biasing unit, the rotational power of the motor is transmitted to the switching unit over the first transmission path, whereas when the pressing member and the heating rotating body are switched from the second state to the first state, the rotational power of the motor is transmitted to the switching unit over the second transmission path. Setting the reduction ratio of the first transmission path to be larger than the reduction ratio of the second transmission path allows for rapid switching of the pressing member and the heating rotating body to the first state, thereby preventing an unnecessary increase in the time before the start of fixing operations. Setting the reduction ratio in this way also allows for a decrease in the load torque on the motor when switching the pressing member and the heating rotating body to the second state, thereby reducing an increase in motor size insofar as possible.

The present invention has been described based on embodiments thereof, but the present invention is of course in no way limited to the above embodiments. For example, the following modifications are possible.

(1) In the above embodiments, an example is described of adopting the present invention in a fixing device that uses the thermal belt fixing method, namely a fixing device that includes a heat roller with an internal heat source, a fixing roller, a fixing belt stretched between the fixing roller and the heat roller to serve as a heating rotating body, and a pressing roller that presses against the fixing roller with the fixing belt therebetween in order to form a fixing nip. The present invention is not, however, limited in this way, and may for example be adopted in fixing devices that use a heat roller fixing method. A fixing device that uses the heat roller fixing method forms a fixing nip by directly pressing a pressing roller, which is a pressing member, against a fixing roller (heating rotating body) with an internal heat source.

(2) In the above embodiments, a pressing roller is used as a pressing member, but the pressing member is not limited in this way. Alternatively, a pressing pad may be used.

(3) In the above embodiments, the pressing member (pressing roller) is moved (displaced) to change the position of the pressing member relative to the heating rotating body (fixing belt), but the present invention is not limited in this way. Alternatively, the heating rotating body may be displaced in order to change the position of the pressing member relative to the heating rotating body.

(4) In the above embodiments, a compression coil spring is used as the biasing unit, but the biasing unit is not limited to a compression coil spring. Alternatively, a different elastic member such as a leaf spring or a sponge may be used. Furthermore, use is not limited to a compression spring, and an extension spring may instead be used.

(5) In the above embodiments, a mechanism including a cam, which is an eccentric member, is used as the switching unit, but the switching unit is not limited to such a mechanism. Instead, another well-known mechanism may be used. In other words, any mechanism that converts the rotational movement from the motor into swinging movement of the swing plate, which is a support member of the pressing roller, may be used. For example, such a mechanism may include a crank and a swing lever. In this case, the swing lever itself may serve as the swing plate. Alternatively, a mechanism that converts rotational movement from the motor into linear movement and causes the support member of the pressing roller to reciprocate linearly with respect to the fixing belt (fixing roller) may be used. For example, a slider-crank mechanism may be adopted.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device comprising:

a heating rotating body driven by a motor;

a pressing member;

a biasing unit configured to place the pressing member and the heating rotating body in a first state by pressing the pressing member and the heating rotating body together with a biasing force so as to form a nip through which a recording sheet with a toner image formed thereon passes;

a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together;

a power transmission mechanism configured to transmit the rotational power of the motor to the switching unit; and a transmission control unit configured to establish and cut off the transmission of the rotational power of the motor to the switching unit by the power transmission mechanism, wherein the power transmission mechanism uses one of a first transmission path and a second transmission path for the transmission of rotational power, a reduction ratio of the first transmission path being larger than a reduction ratio of the second transmission path, and the transmission control unit includes a path selection unit configured to select the first transmission path when the switching unit switches the pressing member and the heating rotating body from the first state to the second state and to select the second transmission path when the switching unit switches the pressing member and the heating rotating body from the second state to the first state.

2. The fixing device of claim 1, wherein the power transmission mechanism includes:

a first external gear and a second external gear attached along a same axis, a diameter of the second external gear being larger than a diameter of the first external gear;

a third gear that engages with the first external gear and transmits power downstream; and a fourth gear that engages with the second external gear and transmits power downstream, the first external gear and the third external gear form a portion of the first transmission path, the second external gear and the fourth external gear form a portion of the second transmission path, and the reduction ratio of the first transmission path is larger than the reduction ratio of the second transmission path due to the diameter of the second external gear being larger than the diameter of the first external gear, and the path selection unit is constituted by a clutch provided within the first transmission path and a clutch provided within the second transmission path.

3. The fixing device of claim 1, wherein the switching unit includes an eccentric member attached to a shaft of the power transmission mechanism and switches the pressing member and the heating rotating body between the first state and the second state in accordance with an eccentricity of the eccentric member, the power transmission mechanism includes:

a first external gear;

an internal gear provided along a same axis as the first external gear and surrounding the first external gear; and a second external gear provided between the first external gear and the internal gear and interlocking with the eccentric member, the first external gear and the internal gear are partially toothed gears each having no teeth in a predetermined angular range, and the second external gear engages with only one of the first external gear and the internal gear in correspondence with a rotational angle of the eccentric member, the first transmission path being formed by the second external gear engaging only with the first external gear and the second transmission path being formed by the second external gear engaging only with the internal gear.

4. An image forming apparatus that forms an image on a recording sheet by electrophotography and includes a fixing device that fixes a toner image to a recording sheet on which the toner image is formed, the fixing device comprising:

a heating rotating body driven by a motor;

a pressing member;

a biasing unit configured to place the pressing member and the heating rotating body in a first state by pressing the pressing member and the heating rotating body together with a biasing force so as to form a nip through which a recording sheet with a toner image formed thereon passes;

a switching unit configured to receive rotational power of the motor in order to switch the pressing member and the heating rotating body from the first state to a second state, in which the pressing member and the heating rotating body are not in contact, by separating the pressing member and the heating rotating body from each other in resistance to the biasing force of the biasing unit, and to switch the pressing member and the heating rotating body from the second state to the first state by allowing the biasing force of the biasing unit to press the pressing member and the heating rotating body together;

a power transmission mechanism configured to transmit the rotational power of the motor to the switching unit; and a transmission control unit configured to establish and cut off the transmission of the rotational power of the motor to the switching unit by the power transmission mechanism, wherein the power transmission mechanism uses one of a first transmission path and a second transmission path for the transmission of rotational power, a reduction ratio of the first transmission path being larger than a reduction ratio of the second transmission path, and the transmission control unit includes a path selection unit configured to select the first transmission path when the switching unit switches the pressing member and the heating rotating body from the first state to the second state and to select the second transmission path when the switching unit switches the pressing member and the heating rotating body from the second state to the first state.

5. The image forming apparatus of claim 4, wherein the power transmission mechanism includes:

a first external gear and a second external gear attached along a same axis, a diameter of the second external gear being larger than a diameter of the first external gear;

a third gear that engages with the first external gear and transmits power downstream; and a fourth gear that engages with the second external gear and transmits power downstream, the first external gear and the third external gear form a portion of the first transmission path, the second external gear and the fourth external gear form a portion of the second transmission path, and the reduction ratio of the first transmission path is larger than the reduction ratio of the second transmission path due to the diameter of the second external gear being larger than the diameter of the first external gear, and the path selection unit is constituted by a clutch provided within the first transmission path and a clutch provided within the second transmission path.

6. The image forming apparatus of claim 4, wherein the switching unit includes an eccentric member attached to a shaft of the power transmission mechanism and switches the pressing member and the heating rotating body between the first state and the second state in accordance with an eccentricity of the eccentric member, the power transmission mechanism includes:

a first external gear;

an internal gear provided along a same axis as the first external gear and surrounding the first external gear; and a second external gear provided between the first external gear and the internal gear and interlocking with the eccentric member, the first external gear and the internal gear are partially toothed gears each having no teeth in a predetermined angular range, and the second external gear engages with only one of the first external gear and the internal gear in correspondence with a rotational angle of the eccentric member, the first transmission path being formed by the second external gear engaging only with the first external gear and the second transmission path being formed by the second external gear engaging only with the internal gear.

* * * * *